US005838808A

United States Patent [19]

Prosser

[11] Patent Number: 5,838,808

[45] Date of Patent: Nov. 17, 1998

[54] ACOUSTICAL CHAIR SYSTEM

[76] Inventor: Douglas Prosser, 430 7th St., New Cumberland, Pa. 17070

[21] Appl. No.: 816,511

[22] Filed: Mar. 13, 1997

[51] Int. Cl.[6] ..... H04R 25/00

[52] U.S. Cl. ..... 381/388; 297/217

[58] Field of Search ..... 381/86, 188, 205; 181/141, 199; 455/90, 95, 344, 347, 350, 351; 297/217

[56] References Cited

U.S. PATENT DOCUMENTS 4,826,245 5/1989 Entratter ..... 297/217

5,482,352 1/1996 Leal et al. ..... 297/217.4

5,624,156 4/1997 Leal et al. ..... 297/217.4

FOREIGN PATENT DOCUMENTS 2227689 11/1974 France ..... 455/95

*Primary Examiner*—Huyen Le

[57] ABSTRACT

A new Acoustical Chair System for providing a sound system incorporated into a conventional chair. The inventive device includes a plurality of speakers secured within the conventional chair, a compact disc/tape/radio player secured within an arm rest of the chair, a conventional VCR secured within another arm rest of the chair, and a universal remote hingeably secured to the arm rest.

6 Claims, 3 Drawing Sheets

14

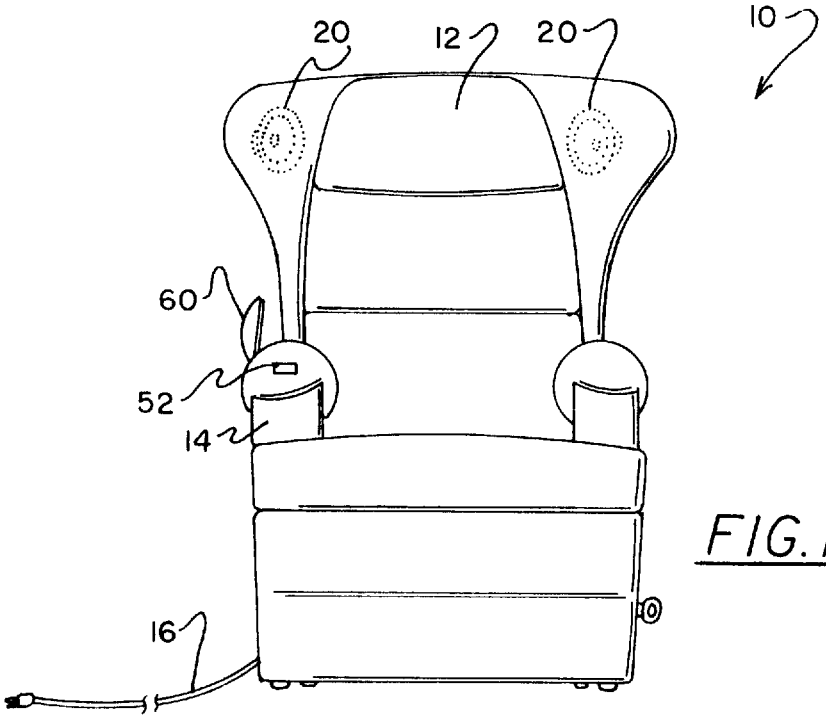
FIG. 1
FIG. 2
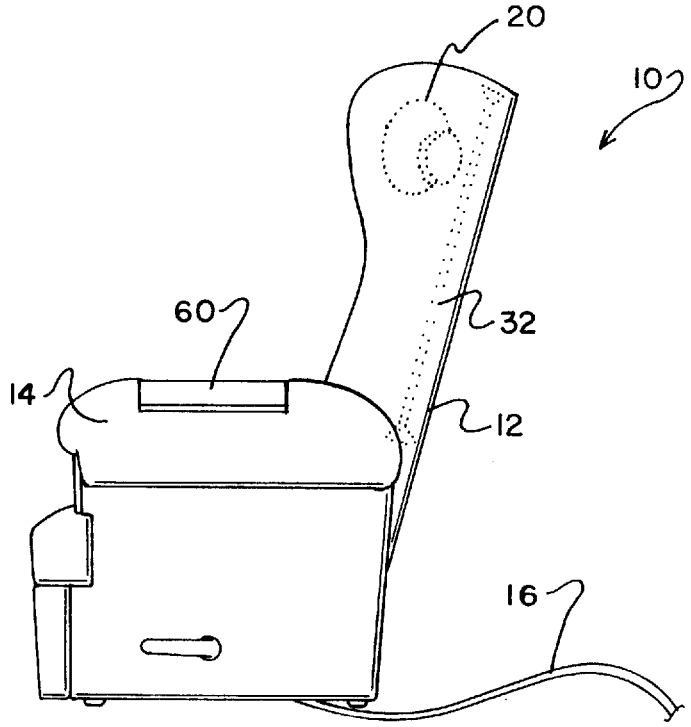

ACOUSTICAL CHAIR SYSTEM

BACKGROUND OF THE INVENTION

1. Field of the Invention

The present invention relates to Musical Chair Devices and more particularly pertains to a new Acoustical Chair System for providing a sound system incorporated into a conventional chair.

2. Description of the Prior Art

The use of Musical Chair Devices is known in the prior art. More specifically, Musical Chair Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Musical Chair Devices include U.S. Pat. No. 5,368,359; U.S. Pat. No. 5,143,055; U.S. Pat. No. 4,868,888; U.S. Pat. No. 4,075,438; U.S. Pat. No. 4,797,934 and U.S. Pat. No. 4,470,631.

While these devices fulfill their respective, particular objectives and requirements, the aforementioned patents do not disclose a new Acoustical Chair System. The inventive device includes a plurality of speakers secured within the conventional chair, a compact disc/tape/radio player secured within an arm rest of the chair, a conventional VCR secured within another arm rest of the chair, and a universal remote hingeably secured to the arm rest.

In these respects, the Acoustical Chair System according to the present invention substantially departs from the conventional concepts and designs of the prior art, and in so doing provides an apparatus primarily developed for the purpose of providing a sound system incorporated into a conventional chair.

SUMMARY OF THE INVENTION

In view of the foregoing disadvantages inherent in the known types of Musical Chair Devices now present in the prior art, the present invention provides a new Acoustical Chair System construction wherein the same can be utilized for providing a sound system incorporated into a conventional chair.

The general purpose of the present invention, which will be described subsequently in greater detail, is to provide a new Acoustical Chair System apparatus and method which has many of the advantages of the Musical Chair Devices mentioned heretofore and many novel features that result in a new Acoustical Chair System which is not anticipated, rendered obvious, suggested, or even implied by any of the prior art Musical Chair Devices, either alone or in any combination thereof.

To attain this, the present invention generally comprises a plurality of speakers secured within the conventional chair, a compact disc/tape/radio player secured within an arm rest of the chair, a conventional VCR secured within another arm rest of the chair, and a universal remote hingeably secured to the arm rest.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Acoustical Chair System apparatus and method which has many of the advantages of the Musical Chair Devices mentioned heretofore and many novel features that result in a new Acoustical Chair System which is not anticipated, rendered obvious, suggested, or even implied by any of the prior art Musical Chair Devices, either alone or in any combination thereof.

It is another object of the present invention to provide a new Acoustical Chair System which may be easily and efficiently manufactured and marketed.

It is a further object of the present invention to provide a new Acoustical Chair System which is of a durable and reliable construction.

An even further object of the present invention is to provide a new Acoustical Chair System which is susceptible of a low cost of manufacture with regard to both materials and labor, and which accordingly is then susceptible of low prices of sale to the consuming public, thereby making such Acoustical Chair System economically available to the buying public.

Still yet another object of the present invention is to provide a new Acoustical Chair System which provides in the apparatuses and methods of the prior art some of the advantages thereof, while simultaneously overcoming some of the disadvantages normally associated therewith.

Still another object of the present invention is to provide a new Acoustical Chair System for providing a sound system incorporated into a conventional chair.

Yet another object of the present invention is to provide a new Acoustical Chair System which includes a plurality of speakers secured within the conventional chair, a compact disc/tape/radio player secured within an arm rest of the chair, a conventional VCR secured within another arm rest of the chair, and a universal remote hingeably secured to the arm rest.

Still yet another object of the present invention is to provide a new Acoustical Chair System that provides entertainment, rest and relaxation for the user.

Even still another object of the present invention is to provide a new Acoustical Chair System that may be electrically connected to a television audio output.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front view of a new Acoustical Chair System according to the present invention.

FIG. 2 is a side view of the present invention.

DESCRIPTION OF THE PREFERRED EMBODIMENT

Figure 3:
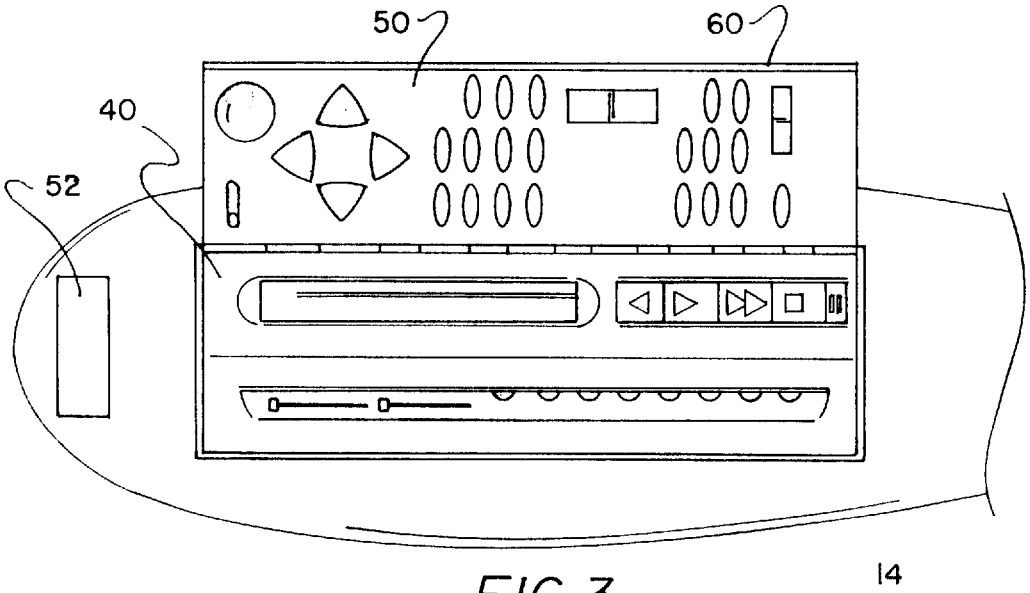
FIG. 3 is a top view of the arm rest containing the compact disc/tape/radio player.

With reference now to the drawings, and in particular to FIGS. 1 through 6 thereof, a new Acoustical Chair System embodying the principles and concepts of the present invention and generally designated by the reference numeral 10 will be described.

More specifically, it will be noted that the Acoustical Chair System 10 comprises a conventional chair 12 having a pair of arm rest 14*s* and an upper back support, a plurality of speakers 20 secured within the upper back support, and a compact disc/tape/radio player 30 secured within one of the arm rests 14 and electrically connected to the plurality of speakers 20 for producing an audible sound for a user sitting within the conventional chair 12.

Figure 4:
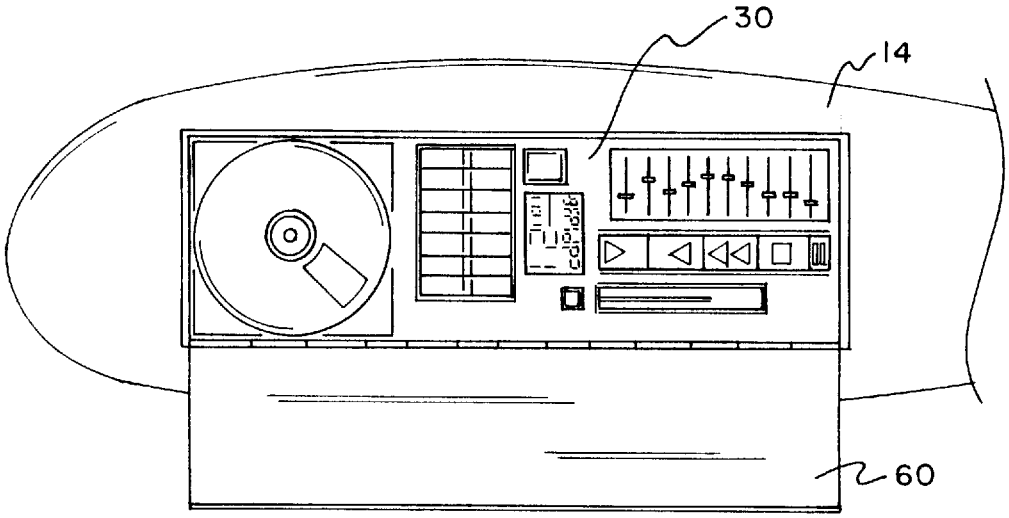
FIG. 4 is a top view of the arm rest containing the conventional VCR.
Figure 5:
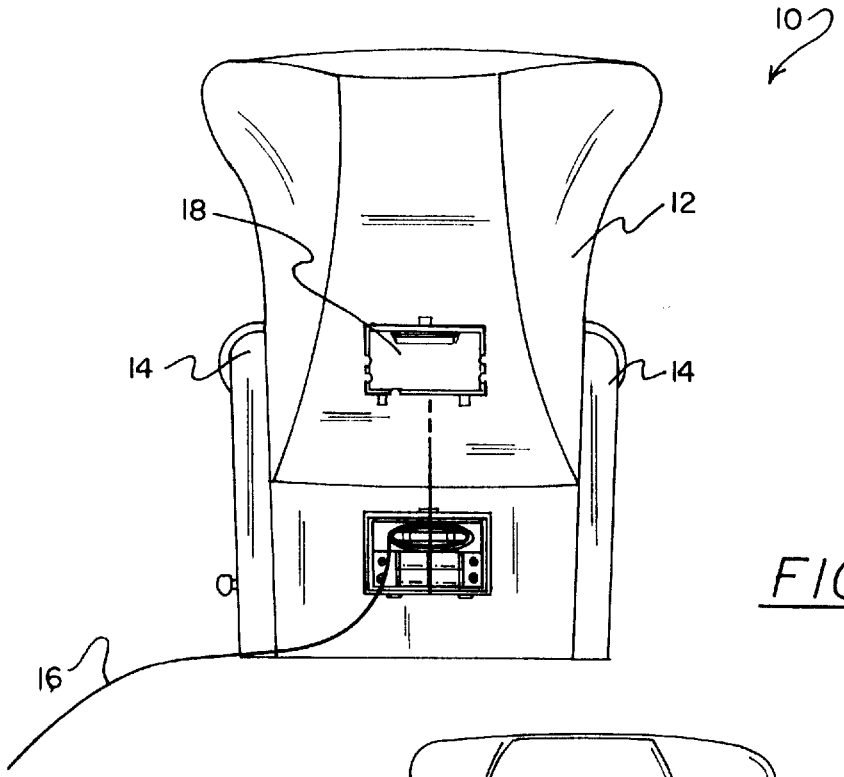
FIG. 5 is a rear view of the present invention.
Figure 6:
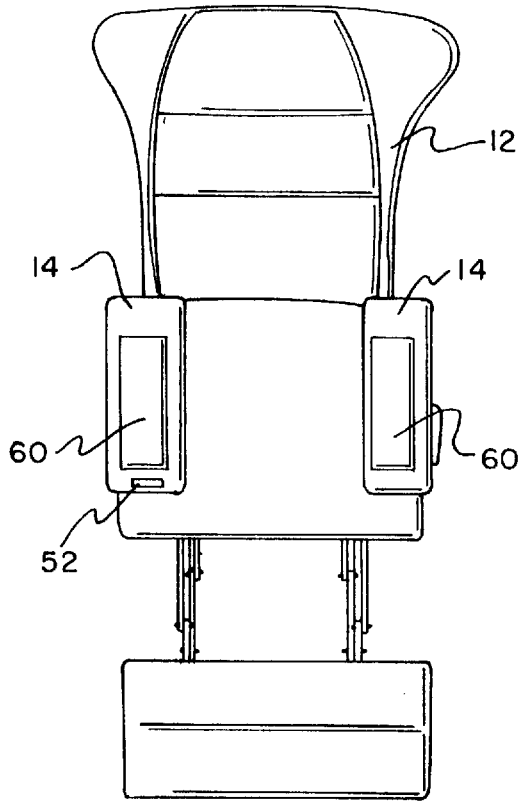
FIG. 6 is a top view of the present invention.

As shown in FIG. 5 of the drawings, an antenna 32 is secured within the upper back support and is electrically connected to the compact disc/tape/radio player 30 for transferring a radio signal to the compact disc/tape/radio player 30. A first cover 60 is pivotally attached to the arm rest 14 containing the compact disc/tape/radio player 30 for allowing selective covering and uncovering of the compact disc/tape/radio player 30 as shown in FIGS. 2, 4 and 6 of the drawings. A conventional VCR 40 is secured within the arm rest 14 opposite of the compact disc/tape/radio player 30 and is electrically connected to the compact disc/tape/radio player 30. A second cover 60 is pivotally attached to the arm rest 14 containing the conventional VCR 40 for allowing selective covering and uncovering of the conventional VCR 40. The second cover 60 preferably has a universal remote control 50 for allowing the user to control a conventional television and other electrical devices. A transmitter 52 is preferably secured within a frontal portion of the arm rest 14 containing the conventional VCR 40 and is electrically connected to the universal remote control 50 for effectively communicating with the conventional television and the other electrical devices. A power cord 16 is electrically connected to the compact disc/tape/radio player 30 and the universal remote control 50. The power cord 16 is stored within an unnumbered cavity projecting into the upper back support of the conventional chair 12 as shown in FIG. 5 of the drawings. A door 18 is removably securable to the upper back support for enclosing the unnumbered cavity.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An acoustical chair system comprising:

a chair having a pair of arm rests and an upper back support;

a plurality of speakers secured within said upper back support;

a compact disc/tape/radio player secured within one of said arm rests and electrically connected to said plurality of speakers for producing an audible sound for a user sitting within said conventional chair;

a first cover pivotally attached to said arm rest containing said compact disc/tape/radio player for allowing selective covering and uncovering of said compact disc/tape/radio player;

a video cassette recorder secured within the arm rest opposite of said compact disc/tape/radio player and electrically connected to said compact disc/tape/radio player; and a second cover pivotally attached to said arm rest containing said video cassette recorder for allowing selective covering and uncovering of said video cassette recorder said second cover including a universal remote control for allowing said user to control a conventional television and other electrical devices.

2. The Acoustical Chair System of claim 1, including an antenna secured within said upper back support and electrically connected to said compact disc/tape/radio player for transferring a radio signal to said compact disc/tape/radio player.

3. An acoustical chair system comprising:

a chair having a pair of arm rests and an upper back support;

a plurality of speakers secured within said upper back support;

a compact disc/tape/radio player secured within one of said arm rests and electrically connected to said plurality of speakers for producing an audible sound for a user sitting within said chair, an antenna secured within said upper back support and electrically connected to said compact disc/tape/radio player for transferring a radio signal to said compact disc/tape/radio player;

a first cover pivotally attached to said arm rest containing said compact disc/tape/radio player for allowing selective covering and uncovering of said compact disc/tape/radio player;

a video cassette recorder secured within the arm rest opposite of said compact disc/tape/radio player and electrically connected to said compact disc/tape/radio player;

a second cover pivotally attached to said arm rest containing said video cassette recorder for allowing selective covering and uncovering of said video cassette recorder, said second cover including a universal remote control for allowing said user to control a television and other electrical devices.

4. The acoustical chair system of claim 3, including a transmitter secured within a frontal portion of said arm rest containing said video cassette recorder and electrically connected to said universal remote control for effectively communicating with said television and said other electrical devices.

5. The acoustical chair system of claim 4, including a power cord electrically connected to said compact disc/tape/radio player and said universal remote control, wherein said power cord is stored within a cavity projecting into said upper back support of said chair.

6. The acoustical chair system of claim 5, including a door removably securable to said upper back support for enclosing said cavity.

* * * * *